US005188039A

United States Patent [19]

Ohmura et al.

[11] Patent Number: 5,188,039

[45] Date of Patent: Feb. 23, 1993

[54] METHOD OF FIXING INSIDE PANEL OF CAR AND STRUCTURE FOR FIXING THE SAME

[75] Inventors: Keiji Ohmura; Sumio Okuno; Kentaro Masai; Hideshi Ooba; Senzoo Hida, all of Kudamatsu; Seiichi Okamoto, Chiba, all of Japan

[73] Assignee: Hitachi, Ltd., Tokyo, Japan

[21] Appl. No.: 752,014

[22] Filed: Aug. 29, 1991

[30] Foreign Application Priority Data

Aug. 29, 1990 [JP] Japan ..... 2-225322
Sep. 19, 1990 [JP] Japan ..... 2-247538

[51] Int. Cl.[5] ..... B61D 17/18
[52] U.S. Cl. ..... 105/423; 105/397
[58] Field of Search ..... 105/396, 397, 401, 423, 105/404, 329.1; 296/39.1, 39.3; 52/45, 53, 56; 24/452, 442, 306

[56] References Cited

U.S. PATENT DOCUMENTS

| | | | |
|---|---|---|---|
| 3,970,526 | 7/1976 | Bender et al. | 105/423 |
| 4,059,056 | 11/1977 | Berryman et al. | 105/423 |
| 4,214,788 | 7/1980 | Srock | 296/39.1 |
| 4,266,487 | 5/1981 | Marulic et al. | 105/423 |
| 4,411,944 | 10/1983 | Moore | 296/39.1 |
| 4,420,183 | 12/1983 | Sherman | 296/39.1 |
| 4,430,835 | 2/1984 | Ericson | 24/306 |
| 4,531,733 | 7/1985 | Hall | 24/542 |
| 4,709,453 | 12/1987 | Harvey et al. | 24/442 |
| 4,861,364 | 8/1989 | Trujillo et al. | 24/442 |
| 5,077,870 | 1/1992 | Melbye et al. | 24/452 |
| 5,090,762 | 2/1992 | Krieger | 296/39.1 |

FOREIGN PATENT DOCUMENTS

| | | | |
|---|---|---|---|
| 0118796 | 9/1984 | European Pat. Off. | 296/39.1 |
| 1455856 | 6/1969 | Fed. Rep. of Germany | 296/39.1 |
| 2814656 | 10/1979 | Fed. Rep. of Germany | 296/39.1 |
| 3408294 | 9/1985 | Fed. Rep. of Germany | 296/39.1 |
| 57-23262 | 5/1982 | Japan . | |
| 0096028 | 6/1984 | Japan | 296/39.1 |
| 60-151166 | 8/1985 | Japan . | |
| 2128565 | 5/1984 | United Kingdom | 296/39.1 |

OTHER PUBLICATIONS

"Car Technology", No. 182, Mar. 1988, pp. 39–48.

*Primary Examiner*—Mark T. Le
*Attorney, Agent, or Firm*—Antonelli, Terry, Stout & Kraus

[57] ABSTRACT

This invention relates to a method of fixing an inside panel of a car, and its fixing structure. In a structure for fixing an inside panel by employing an interior decoration material to form a passenger room of a car, the present invention relates to a method and a structure for fixing an inside panel of a car, particularly suitable for a railway car. An inside frame which is press-formed is fixed to frames of a car, and an inside panel is fixed to the inside frame through fasteners. Since the inside panel is fixed to the press-formed inside frame, surface uneveness does not occur on the inside panel even if any unevenness exists on the frames of the car. A cushion material is attached to the inside frame at the joint portion of two inside panels along the joint portion. The inside panel has a decoration sheet bonded to its surface, and this decoration sheet is bent back at the edge portions of the inside panel. Therefore, the appearance of the joint portion can be improved.

9 Claims, 10 Drawing Sheets

METHOD OF FIXING INSIDE PANEL OF CAR AND STRUCTURE FOR FIXING THE SAME

BACKGROUND OF THE INVENTION

1. Field of the Invention

In a structure for fixing an inside panel (interior decoration material) constituting a passenger room of a car, the present invention relates to a method of fixing an inside panel and a structure for fixing inside panels, which are particularly suitable for a railway car.

2. Description of the Prior Art

A conventional structure for fixing an inside panel of a railway car is disclosed in Japanese Utility Model Publication No. 23262/1982. As shown in FIG. 1 of this reference, an inside panel is put onto frames fixed to an outside panel of a car through packings and is fixed by screws. Battens are attached by screws to the joint portion of the inside panels to cover the joint portion.

This fixing procedure will be explained. A packing is bonded by adhesive to a frame fixed to a car by welding. A cutting is then made so that the planes of a plurality of packings becomes flush, so as to eliminate unevenness of the surfaces that occurs due to welding. After tap screw holes are bored in the frames, the inside panels are fixed by screws.

The prior art technique described above involve problems in that the structure is complicated, the number of man-hours is larger and the appearance is poor.

To solve these problems, the prior art reference described above proposes a method illustrated in FIGS. 2 to 4. Fasteners are provided on a frame and an inside panel, and the inside panel is fixed by the fasteners.

At the joint portion of the inside panels, one edge portion of the inside panels is shaped in a Z-shape and one edge portion of the other is shaped in an L-shape so that they can be engaged with each other.

The system, using fasteners described above, eliminates the necessity for screws and the number of man-hours is reduced. In the operation procedure of this system, frames are fixed to the car body and then fasteners are fixed to the frames by adhesive. Therefore, the reduction of the number of man-hours is small.

The system using fasteners does not require any specific treatment for the structure of the joint portion of the inside panels but does require the end portions of the inside panels to be bent.

Structures for fixing inside panels are shown in Photo 7, pp. 44 in "Car Technology", No. 182, (1988-3) and Japanese Patent Laid-Open No. 151166/1986. Neither of these references suggest the use of fasteners. The structure shown in the former reference is the one for fixing inside panels in a door pocket portion for storing a sliding door. The inside panels are fixed to inner frames of a weld structure secured to posts of a door pocket. In the structure disclosed in the latter reference, spacers of angle members are provided on ribs of outside panels and the inside panel are fixed to this spacer.

The present invention is directed to provide a more economical method and structure for fixing inside panels.

SUMMARY OF THE INVENTION

By a method of fixing inside panels in accordance with the present invention, an inside panel is fixed by fixing an inside frame having a plurality of first fasteners on the surface thereof to a plurality of frames of a car, and then by pressing an inside panel having second fasteners fitted to the back thereof to the first fasteners to fix the inside panel.

A structure for fixing an inside panel in accordance with the present invention comprises a plurality of first frames of a car, an inside frame fixed to the first frames and having a plurality of first fasteners attached to the surface thereof, an inside panel having second fasteners corresponding to the first fasteners and disposed in positions facing the first fasteners, wherein the inside panel is fixed to the inside frame by the first and second fasteners.

Other features of the present invention will become more apparent from the following description.

DESCRIPTION OF THE PREFERRED EMBODIMENTS

Figure 8:
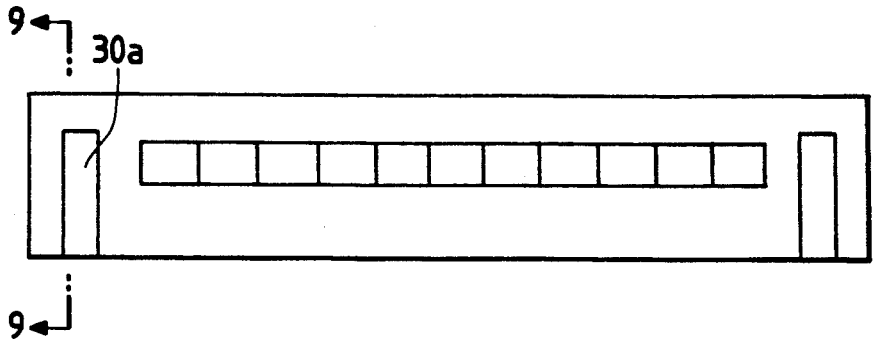
FIG. 8 is a side view of a car.
Figure 9:
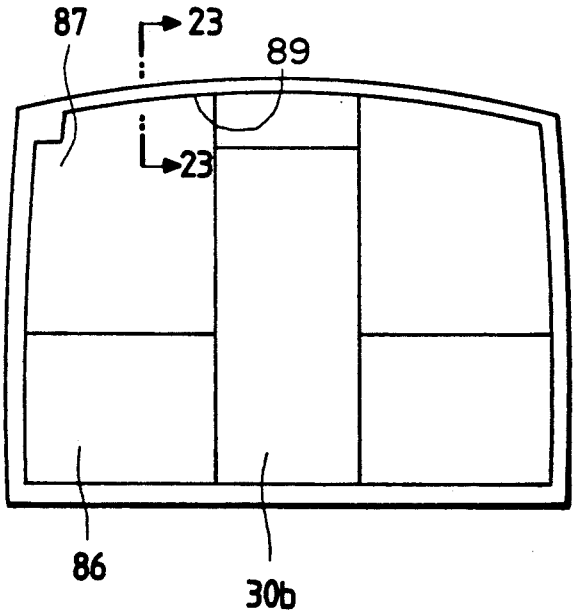
FIG. 9 is a view taken along line 9—9 of FIG. 8.

A first embodiment of the present invention will be explained with reference to FIGS. 1 to 9. Entrances 30*a* are provided on the sides of a car as shown in FIG. 8, and an entrance 30*b* is provided on the end of the car in its longitudinal direction as illustrated in FIG. 9. A sliding door of each of the entrances 30*a*, 30*b* can be stored in a door pocket. This embodiment relates to a structure for fixing inside panels of this door pocket portion. The entrances 30*a* and 30*b* are substantially the same, and the following description will be directed to a structure for fixing the inside panels of the door pocket portion of the entrance 30*a* on the side.

Figure 3:
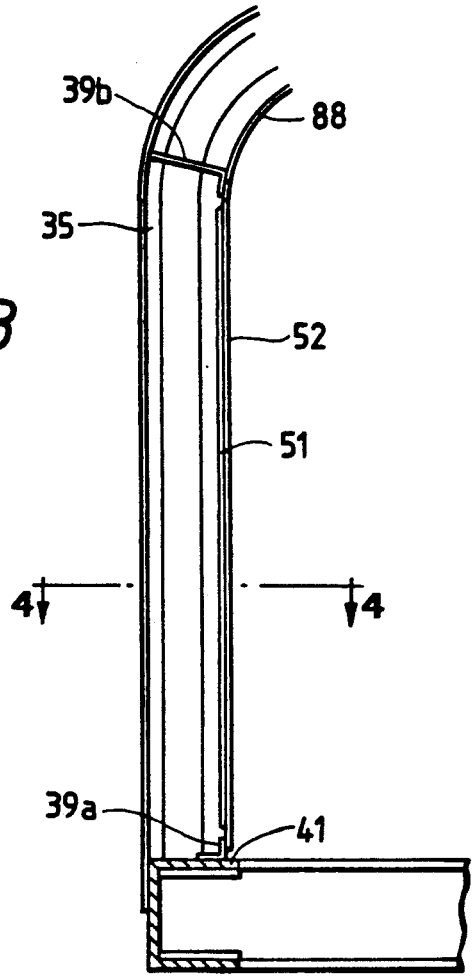
FIG. 3 is a longitudinal sectional view of a door pocket portion.
Figure 4:
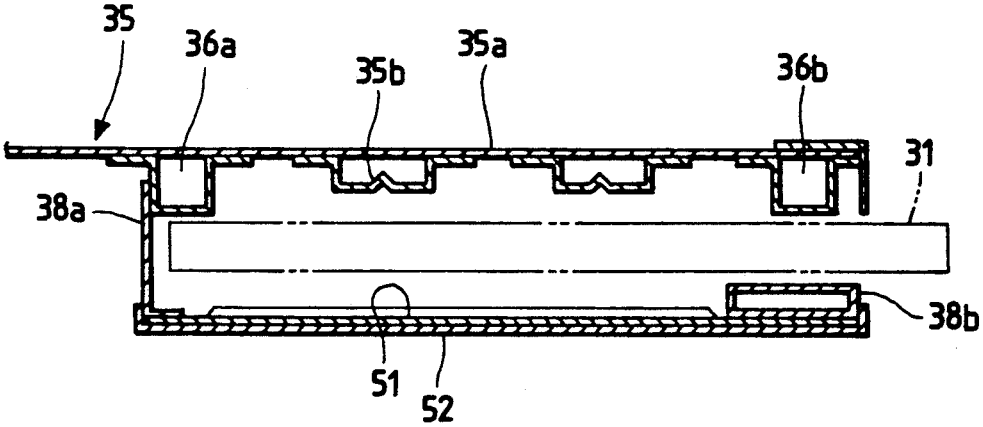
FIG. 4 is a sectional view taken along line 4—4 of FIG. 3.

In FIGS. 3 and 4, the sliding door 31 is stored between a structure 35 constituting the outside wall of the car and the inside panel 52. The structure 35 comprises an outside panel 35*a*, a frame 35*b* disposed in a vertical direction and a frame (not shown) disposed in a horizontal direction. Posts 36*a*, 36*b* are welded to the outside panel 35*a* at the portion of the door pocket, and posts 38*a*, 39*a* are disposed to fix the inside panel 52 of the door pocket thereto. The lower part of each post 38*a*, 38*b* is fixed to a bracket 39*a* disposed on a floor 41 and the upper end is fixed to a bracket 39*b* disposed in the structure. The post 38*a* is also fixed to the post 36*a*. The posts 36*a*, 36*b* and the bracket 39*b* are also referred to as "frames" constituting the structure 35.

The inside panel 52 is fixed by fasteners to an inside frame 51 which is fixed to the posts 38*a* and 38*b*.

The inside frame 51 has substantially the same size as the inside panel 52 and is fixed to the posts 38*a*, 38*b* by spot welding, by blind rivets or fixing screws. The inside frame 52 is fixed to one post 38*a* (38*b*) in a plurality of positions in the vertical direction.

Figure 1:
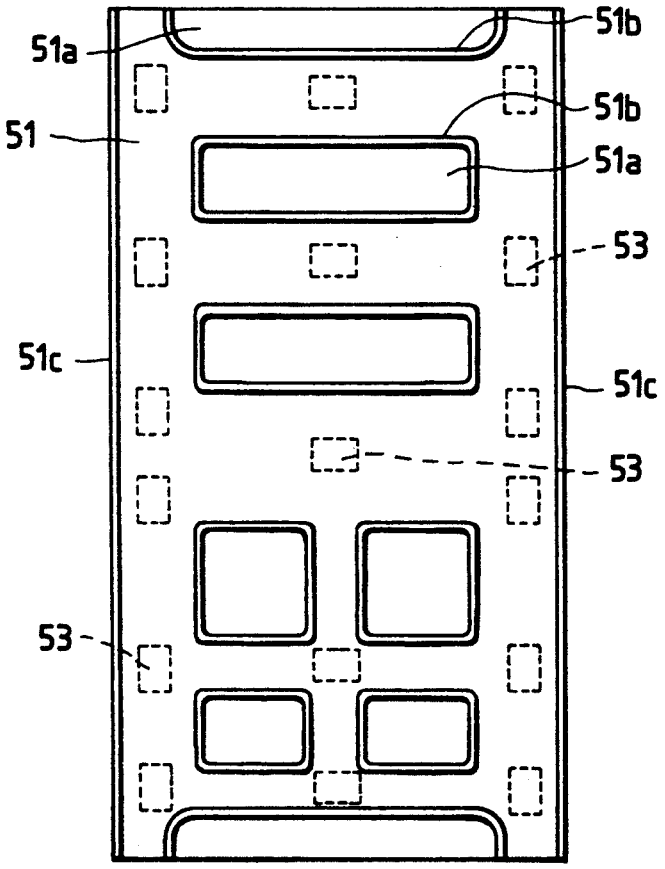
FIG. 1 is a front view of a structure for inside panel disposition, of an embodiment according to the present invention, showing an inside frame and an inside panel when they are viewed from the back side.
Figure 2:
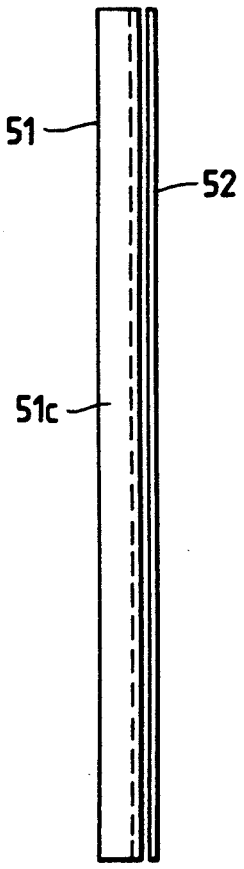
FIG. 2 is a right-hand side view of FIG. 1.

In FIGS. 1 and 2, the inner frame 51 is constructed by defining openings 51*a* at appropriate positions of a thin sheet and bending the peripheral portions of the openings 51*a* as well as both end portions of the thin sheet. Reference numerals 51*b* and 51*c* denote flanges that are formed by bending. The flanges 51*b*, 51*c* project towards the structure 35, that is, towards the inside of the door pocket. The inside frame 51 is press-formed by an automatic machine such as an NC machine.

Reference numeral 53 designates fasteners. The fasteners are bonded to a plurality of necessary positions of the facing surfaces of the inside frame 51 and the inside panel 52 by an adhesive. The positions of the fasteners are determined in accordance with the required fixing strength of the inside panel 52 and of the prevention of unevenness of the surface of the inside panel 52.

Figure 6:
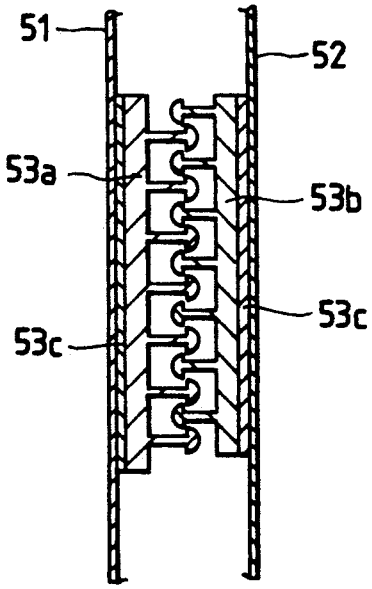
FIG. 6 is a sectional view of fasteners joined to each other.
Figure 7:
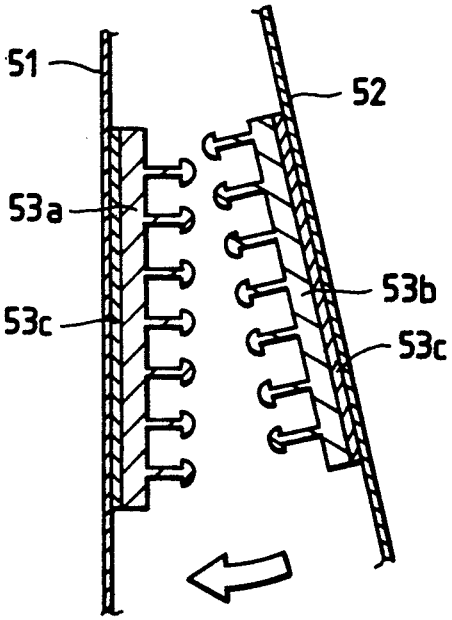
FIG. 7 is a sectional view of the fasteners before they are joined.

As shown in FIGS. 6 and 7, the fasteners 53 comprises a fasteners 53*a* attached to the inside frame 51 and a fastener 53*b* attached to the inside panel 52, and they are attached to positions corresponding to each other. Sponge-like cushion materials 53*c*, 53*c* are disposed on the back of these fasteners 53*a* and 53*b*, respectively. An adhesive is coated on both surfaces of the cushion material 53*c*.

Figure 5:
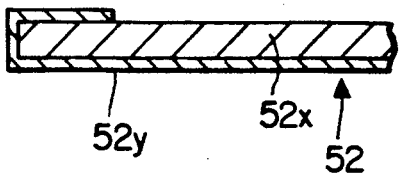
FIG. 5 is a sectional view of an end portion of an inside panel.

As shown in FIG. 5, the inside panel 52 is constructed by bonding a decoration sheet 52*y* on the surface of a thin metal sheet 52*x*. The decoration sheet 52*y* is wound onto the back side at both ends of the metal sheet 52*x*. Therefore, even when the end portions of the inside panel 52 are seen from the passenger room side, the inside panel 52 provides a good appearance.

Next, the procedure of fixing the inside panel 52 will be explained. The structure 35 and the posts 36*a*, 36*b*, 38*a*, 38*b* of the door pocket portion are assembled in a conventional manner. The fasteners 53*a*, 53*b* are fixed at suitable positions of the inside frame 51 and inside panel 52 by an adhesive. Next, the inside frame 51 to which the fasteners 53*a* are fixed are fixed to the posts 38*a*, 38*b* by blind rivets. Next, the inside panel 52 is pressed to the inside frame 51 so that the fasteners 53*a*, 53*b* mesh with one another. The inside panel 52 is fixed to the inside frame 51 by the fasteners 53.

As described above, there is provided one inside frame 51 to which a plurality of fasteners 53*a* are provided. This inside frame 51 is formed by bending one sheet. Therefore, the number of man-hours is reduced much more than the method by which a plurality of fitting plates are fixed between a pair of posts 38*a*, 38*b* by welding and then the fasteners 53*a* are fixed.

If the fitting plates described above are fixed by welding, large distortion occurs. In accordance with the embodiment described above, the inside frame is formed from one sheet. Accordingly, unevenness of the surface is less and the appearance of the surface of the inside panel 52 is good.

The inside frame 51 having the fasteners 53*a* fitted thereto is fixed to the posts 38*a*, 38*b* of the structure 35*a*. Accordingly, the attachment work of the fasteners 53*a* can be converted to a so-called "outwork" and the efficiency of the work can be improved.

The inside frame 51, which is constructed by bending one sheet, has higher degree of flatness than the inside frame 51 which is formed integrally by welding, so that the inside frame 52 fitted to the former becomes flat, as well. Even if same unevenness exists on the inside frame 51, since the pair of fasteners 53, 53*b* have a sufficient meshing margin, and since the cushion materials 53*c* are provided on the fitting surfaces of the fasteners 53*a*, 53*b*, they present an uneven surface on the inside panel 52.

Next, other embodiments of the present invention will be explained with reference to FIGS. 10 to 20, wherein like reference numerals will be used to identify like constituent elements.

In each of the following embodiments, the inside frame and the inside panel have the same constructions as the inside frame 51 and the inside panel 52 described above, and they likewise have the fasteners 53*a*, 53*b*.

First, an embodiment shown in FIG. 10 will be explained. Reference numeral 51 designates an inside frame having the same construction as described above, and its lower end is bent towards the inside panel 52 to form a flange 55*a*. The inside frame 51 is fixed to the posts 38*a*, 38*b* in the same way as in the first embodiment, and has fasteners 53*a*. While a lower portion 52*a* is placed on the flange 55*a*, the inside panel 52 is pressed to the inside frame 51 to cause their fasteners 53*a*, 53*b* to mesh with one another. Thus, the inside panel 52 is fixed to the inside frame 51. Accordingly, the weight of the inside panel 52 is directly and partly borne also by the inside frame 51, and the portion of the weight of the inside panel 52 borne by the fasteners 53*a*, 53*b* are reduced. In comparison with the first embodiment, therefore, this embodiment can reduce the number of positions of disposition of the fasteners 53*a*, 53*b*. Since the inside panel 52 is supported reliably by the flange 55*a* of the inside frame 51, the reliability of the fixing structure utilizing the fasteners 53*a*, 53*b* can be remarkably improved.

Figure 11:
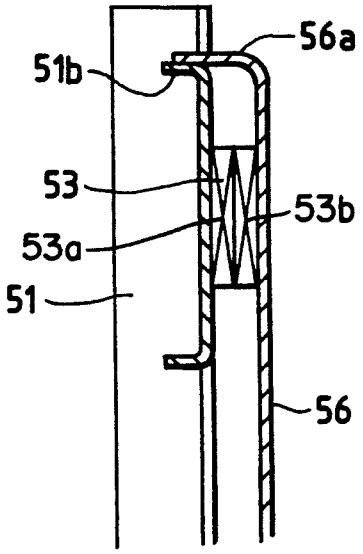
FIG. 11 is a longitudinal sectional view showing upper portions of the inside frame and inside panel.

Next, an embodiment shown in FIG. 11 will be explained. Reference numeral 56 represents an inside panel which is similar to the one described above. The upper end 56*a* of the inside panel 56 is bent towards the inside frame 51 to provide a flange. The inside panel 56 is pressed to the inside frame 51 while its flange 56*a* is placed on the upper end 51*b* of the inside frame 51, and is fixed by causing their fasteners 53*a*, 53*b* to engage with one another.

Figure 10:
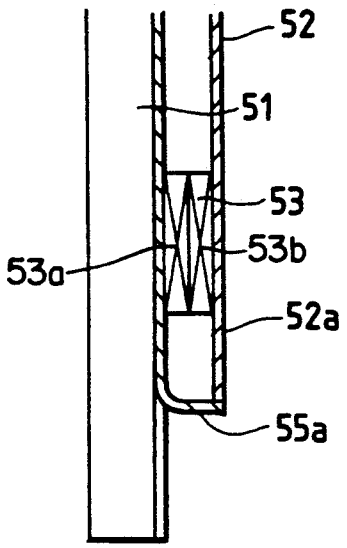
FIG. 10 is a longitudinal sectional view showing lower portions of an inside frame and an inside panel.

Accordingly, the weight of the inside panel 56 is also borne directly by the inside frame 51 and the same effect as that of the second embodiment illustrated in FIG. 10 results.

Figure 12:
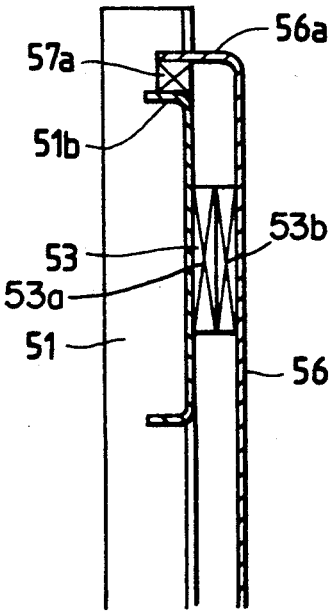
FIG. 12 is a longitudinal sectional view showing upper portions of the inside frame and inside panel of another embodiment.

Next, an embodiment illustrated in FIG. 12 will be explained. Reference numeral 57*a* represents a cushion material made of a rubber, or the like. Here, the inside frame 51 is manufactured in the same way as in the first embodiment and is then fixed to the car. The inside panel 56 has a greater height than that of the embodiment illustrated in FIG. 10 by the amount corresponding to the thickness of the cushion material 57*a*. The inside panel 56 is pressed to the inside frame 51 while the cushion material 57*a* at its upper end is placed on the upper end 51*b* of the inside frame 51, and is fixed to the inside frame 51 by engaging their fasteners 53*a*, 53*b* with one another.

Accordingly, the weight of the inside panel 56 is borne uniformly in the longitudinal direction of the upper end 51*b* of the inside frame 51, so that load borne by the fasteners 53*a*, 53*b* becomes uniform correspondingly. Since the inside frame 51 and the panel 56 do not directly contact each other, creaking noises at this portion do not occur.

Figure 13:
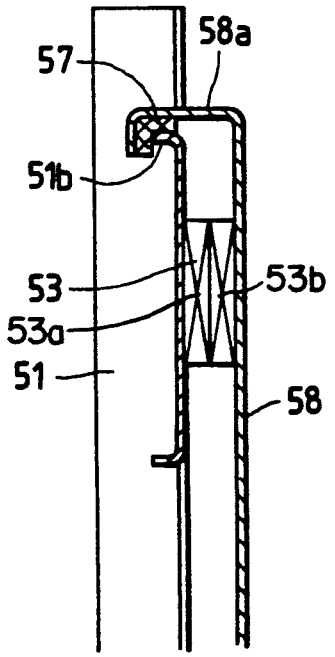
FIG. 13 is a longitudinal sectional view showing upper portions of the inside frame and inside panel of still another embodiment.

Next, an embodiment illustrated in FIG. 13 will be explained. The edge of the flange 58*a* is further bent in a hook-like shape in such a manner as to extend to the back of the flange 51*b* at the upper end of the inside frame 51. The cushion material 57 is provided along the shape of the flange 58*a* of the inside panel 58. After the flange 58*a* at the edge of the inside, panel 58 is hooked and positioned to the flange 51*b* of the inside frame 51 through the cushion material 57, the inside panel 58 is pressed and fixed to the inside frame 51 by the engagement of the fasteners 53*a*, 53*b*.

Even if the fasteners 53*a*, 53*b* disengage from one another for some reason, the inside panel 58 is reliably retained by the flange 58*a* and hence, the problem of the premature removal of the inside panel 58 is eliminated.

Figure 14:
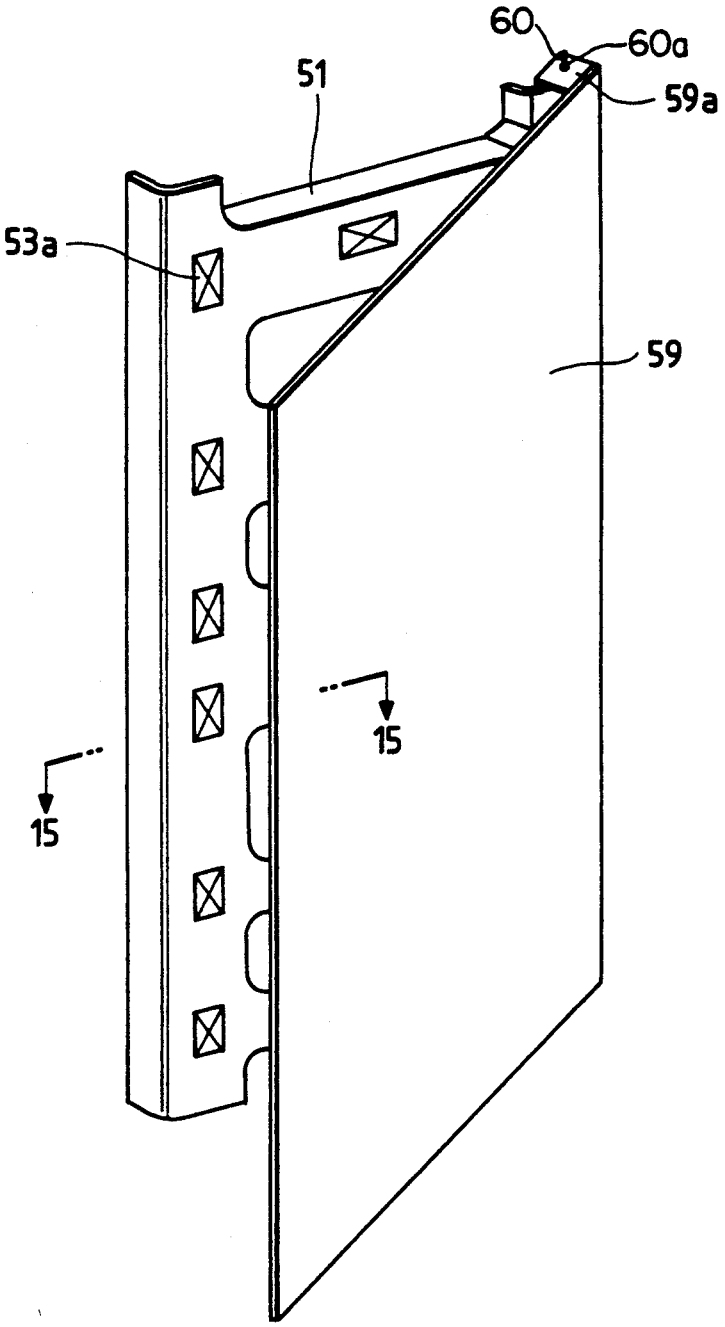
FIG. 14 is a perspective view showing the inside frame and inside panel in still another embodiment.

Next, an embodiment illustrated in FIG. 14 will be explained. Pins 60 are disposed at the upper and lower ends on the right side of the inside frame 51 and support rotatably the right side of the inside panel 59. The upper and lower portions on the right side of the inside panel 59 are longer than the other portions. After pin holes 60*a* are bored, the longer portions are bent in the direction of the inside frame 51 to form pin coupling portions 59*a*. These pin coupling portions 59*a* are aligned with the pin support portions of the inside panel 51 and coupled together by the pins 60. In this manner, the inside panel 59 is coupled to the inside frame 51. Thereafter, the inside panel 59 is rotated around the pin 60 and is pressed and fixed to the inside frame 51.

Since part of the weight of the inside panel 59 is borne by the pin coupling portions 59*a* as described above, the load bearing ratio of the fasteners 53*a*, 53*b* is reduced. Accordingly, the number of the attached fasteners 53*a*, 53*b* can be reduced and reliability of holding the inside panel 59 can be improved. Since the inside panel 59 can be opened and closed by the rotation around the pin coupling portions 59*a*, inspection of internal components can be made by opening the inside panel 59.

Figure 15:
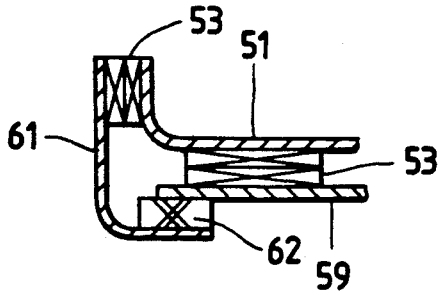
FIG. 15 is a sectional view corresponding to the section along line 15—15 of FIG. 14.

FIG. 15 shows a state where the inside panel 59 is pressed and fixed to the inside frame 51, and then, battens 61 are fixed to both side by utilizing the fasteners 53*a*, 53*b*. A cushion material 62 is disposed on the battens 61 on the side of the inside panel 59 in such a manner as to press the end portion of the inside panel 59. If such battens 61 are disposed, the appearance of the end portion of the inside panel 59 can be improved.

Figure 16:
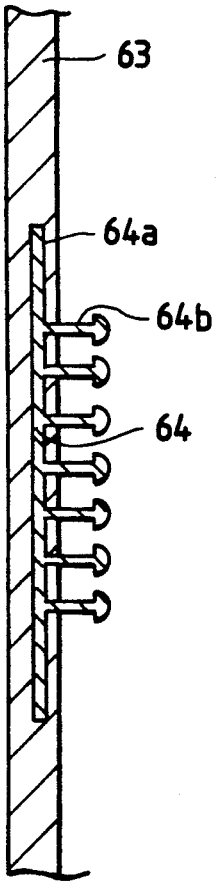
FIG. 16 is a sectional view of a fastener portion of the inside panel in still another embodiment.

Next, an embodiment shown in FIG. 16 will be explained. Reference numeral 63 denotes an inside panel made of a composite material and reference numeral 64 denotes a fastener buried in the inside panel 63 made of the composite material. In this embodiment, the outer peripheral portion 64*a* of the fastener 64 is shaped with a greater width, and the height of projections 64*b* is greater than that of the fastener 53*a* of the embodiment of FIGS. 14 and 15. This fastener 64 is buried in the inside panel 63 during the manufacture of the inside panel 63 as shown in FIG. 16. In the inside panel 63 having the fastener 64 buried therein in this manner, the bonding strength between the fastener 64 and the inside panel 63 is improved in comparison with the embodiment described above. In other words, the reliability of strength of the coupling portion between the fastener 64 and the fastener 53*a* is improved.

Figure 17:
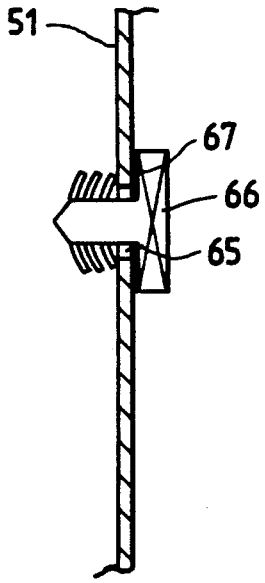
FIG. 17 is a sectional view showing another embodiment of the fastener.

Next, an embodiment shown in FIG. 17 will be explained. Hole 65 is bored in the fastener disposition position of the inside frame 51, and fastener 66 is shaped in an arrow shape, has a mechanical self-fastening function and can be fixed when pushed merely into the hole 65 of the inside frame 51. Adhesive 67 is coated on the contact surfaces of the inside frame 51 and the fastener 66. In this embodiment, the hole 65 for fixing the fastener 66 is simultaneously bored during the process of fabricating the inside frame 51 from a thin sheet. Next, the adhesive 67 is coated on the fastener 66 on the side of the inside frame and around the hole 65 of the inside frame 51 and then the fastener 66 is pushed into the hole 65 of the inside frame 51. In this state, the fastener 66 is fixed to the inside frame 51 by the adhesive in combination with its arrow-shaped self-fastening function.

In this manner, the play of the fastener 66 inside the hole 65 of the inside frame 51 can be suppressed and the vibration of the inside panel is prevented after it is fixed.

Figure 18:
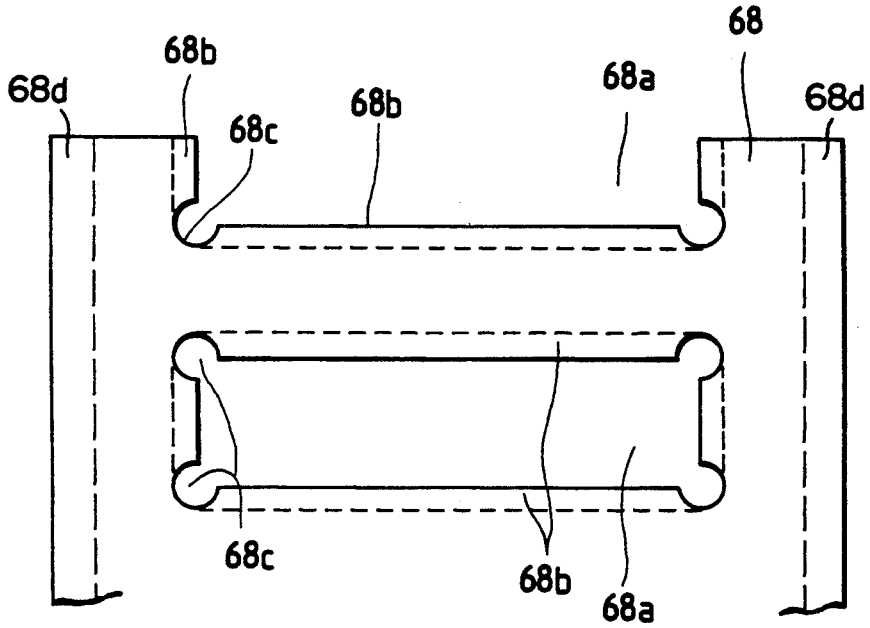
FIG. 18 is a front view showing another embodiment of the inside frame.
Figure 19:
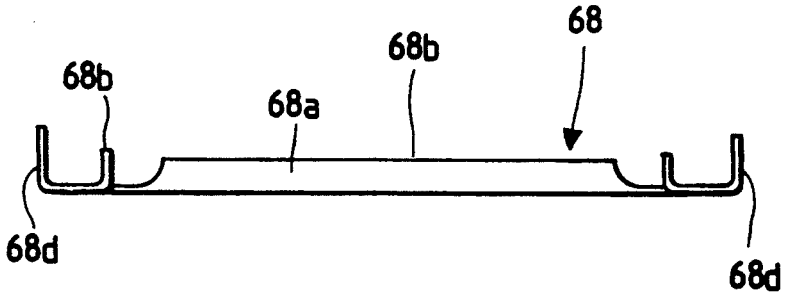
FIG. 19 is a plan view of FIG. 18.

FIGS. 18 and 19 illustrate the process of manufacturing the inside frame 51. When the inside frame 68 is made of a thin sheet, it is first formed in such a manner that the linear portion 68*b* of the opening 68*a* of the inside plate 68 is much more protruded than the corner portions 68*c* as illustrated in FIG. 18. Next, this protruded portion 68*b* is bent outside with respect to the room side to form a flange. Both right and left end portions of the inside frame 68 is bent outward to form a flange 68*d*.

Figure 20:
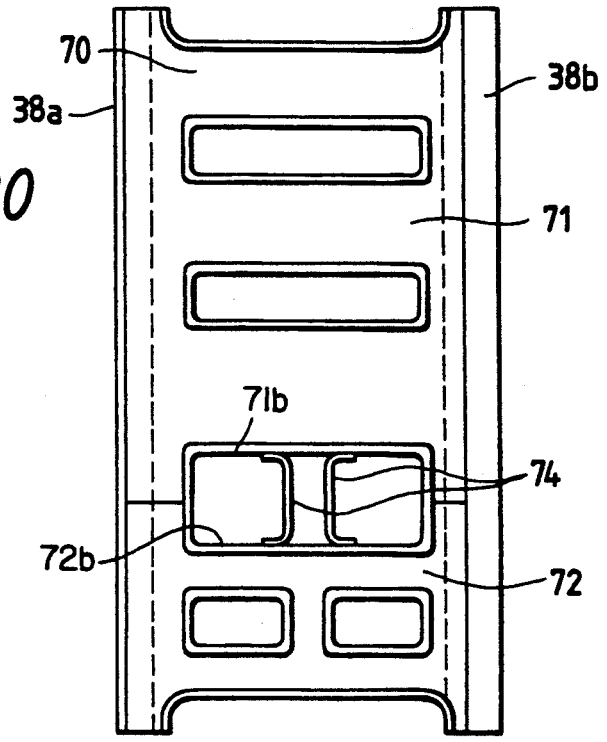
FIG. 20 is a front view showing another embodiment of the inside frame.

Next, still another embodiment of the invention will be explained with reference to FIG. 20. In this embodiment, an inside frame 70 which includes a combination of an inside frame 71 which is standardized and an inside frame 72 which is produced individually is illustrated. Reference numeral 74 designates a framework for connecting the inside frames 71 and 72, and they are coupled at their flanges 71*b*, 72*b*. First, the standard framework 71 which is in common to each inside frame 70 and the specific frame 72 which is peculiar to each inside frame are manufactured separately. Next, the standard framework 71 and the specific framework 72 are disposed between the posts 38*a* and 38*b* disposed at the door pocket portion of the car, and the standard framework 71 and the specific framework 72 are fixed by spot welding or mechanical coupling means such as screws or blind rivets. An assembly framework 74 is disposed between, the standard framework 71 and the specific framework 72, whenever necessary, and are fixed by spot welding or by screws or blind rivets. This assembly framework 74 may be fixed either before or after the standard framework 71 and the specific framework 72 are fixed between the posts 38*a* and 38*b*.

In such a manner, the standard framework 71 can be manufactured in large quantities by press machining in a short time and the total manufacturing time of the inside frame 70 can be reduced. The man-hour of manufacturing the specific frameworks 72 can be reduced, too, by increasing the kinds of the standard framework 71 and combining them suitably.

Figure 21:
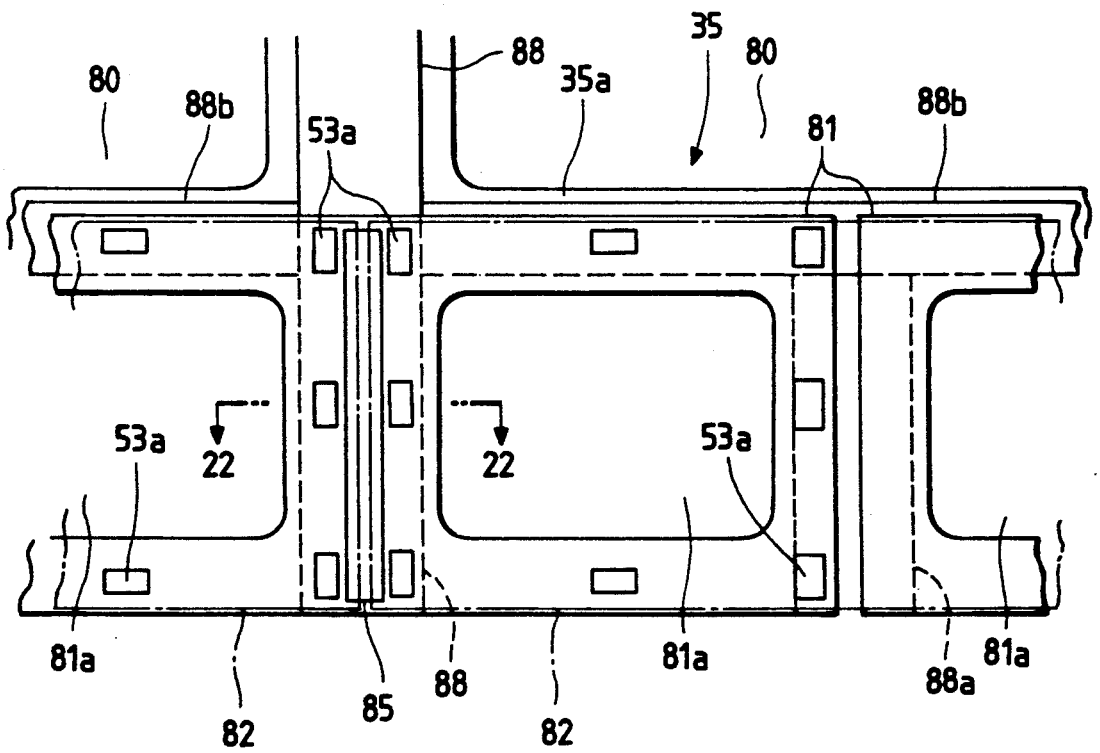
FIG. 21 is a front view showing a structure for fixing inside panels below a window.
Figure 22:
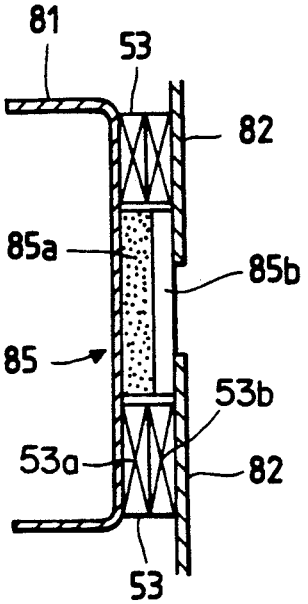
FIG. 22 is a sectional view taken along line 22—22 of FIG. 21.

Still another embodiment shown in FIGS. 21 and 22 will be explained. This embodiment relates to the fitting structure of the inside panel 82 in a part below a window 80. Frames 88, 88*a* are fixed to a structure at regular intervals in the longitudinal direction. Frames 88*b* are disposed also in the horizontal direction. The inside frame 81 is fixed to the frames 88, 88*a*, 88*b* by blind revets, or the like. The fasteners 53*a*, 53*b* are attached to the inside frame 81 and to the inside panel 82. The joint portion of the inside frames 81 and 81 in the horizontal direction exists at the portion of the frame 88*b*. The joint portion of the inside panels 82 and 82 exists at the portion of the frame 88. The opening 81*a* is made in the inside frame 81, and its peripheral portion is bent towards the structure 35. Two rows of fasteners 53*a*, 53*a* are fitted on the right and left to the joint portion of the inside panels 82 and 82. The cushion material 85 is fixed to the inside frame 81 between the two-row fasteners 53*a*, 53*a*. In advance a chloroprene (hereinafter referred to as "CR") type rubber 85*b* is bonded to the surface of a cushion material 85*a* made of a CR type sponge, or the like. The rubber 85*b* is harder than the cushion material 85*a*. The color of the rubber 85*a* is a blackish one. After this cushion material 85 is bonded to the inside frame 81, the inside panels 82, 82 are fixed by the fasteners 53*a*, 53*b*. The joint portion is disposed on one inside frame 81.

The structure of the end surfaces of the inside panels 82, 82 are such as illustrated in FIG. 5. Therefore, the appearance is not degraded even though the end portions of the inside panel 82 are not bent towards the back side or the end portions are not covered with other member.

When the inside panels 82, 82 are fixed, they are pressed while leaving a certain gap between them, but they can be easily positioned by inserting a jig having a predetermined thickness into the gap. The appearance does not degrade much even if the dimensions differ to some extents. Even if there are some differences in level between the surfaces of the inside panels 82 and 82, these differences are absorbed by the cushion material 85, so that gaps do not occur between the surface rubber 85*b* and the inside panels 82, 82 and the appearance does not degrade much. Since the relatively hard protective rubber 85*b* is provided on the surface of the cushion material 85*a*, damage of the cushion material 85 by fingers of passengers, and the like, is prevented.

The color of the rubber 85*b* is determined in consideration of the design, and so forth.

Though in the embodiment described above the joint portion is provided in the horizontal direction, the joint portion can be provided in the vertical direction. For example, this embodiment can be applied to the joint portion of the inside panels 86, 87 at the end of the car in the longitudinal direction as illustrated in FIG. 9.

Figure 23:
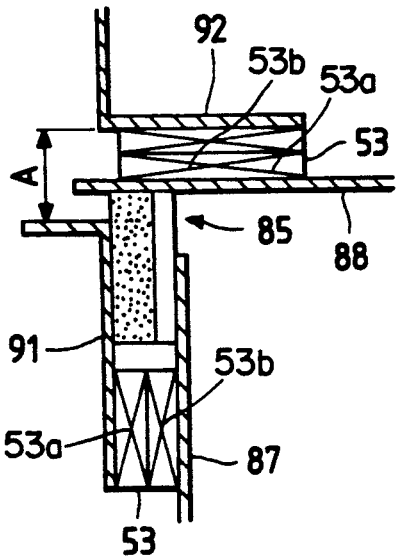
FIG. 23 is a sectional view taken along line 23—23 of FIG. 9.

FIG. 23 illustrates a joint portion of two inside panels 87, 88 that are substantially perpendicular to each other. This corresponds to the sectional view taken along line 23—23 in FIG. 9. After the inside panel 88 of the ceiling is fixed to the frame 92 of the ceiling by the fasteners 53*a*, 53*b*, the cushion material 85 is bonded to the inside frame 91. In this case, the cushion material 85 is bonded to the inside frame 91 in such a manner that the end surface of the cushion material 85 contacts the inside panel 88. Next, the inside panel 87 of the vertical surface is fixed to the inside frame 91 by the fasteners 53*a*, 53*b*.

Since the cushion material 85 is flexible, it can be fitted without any gap even if the inside panel 88 of the ceiling is shaped as an upwardly projecting arc. Therefore, the joint portion is difficult to see from the room side and the cutting accuracy of the upwardly projecting arc of the inside panel 87 is lowered. Accordingly, even at the joint portion where the inside panels are provided substantially perpendicular to each other, the jointing work of the inside panels can be done without any specific machining. If a gap A for inserting the ceiling inside plate 88 is defined between the ceiling frame 92 and the inside frame 91 of the vertical surface, the sizes of the inside panels 88 of the ceiling need not be modified and the adjustment work becomes unnecessary.

In this embodiment, the inside panel 87 and the inside panel 88 may be exchanged for each other.

Figure 24:
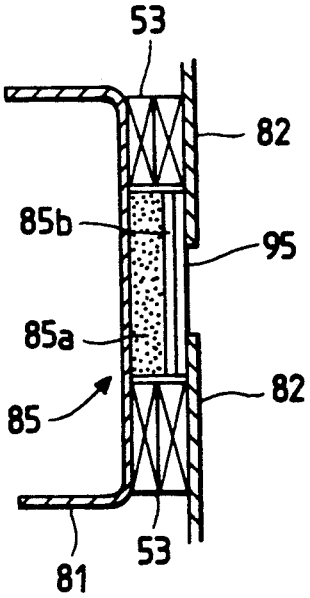
FIG. 24 shows another embodiment corresponding to FIG. 22.

In still another embodiment shown in FIG. 24, the joint portion is more inconspicuous because a decorative paper sheet 95 having the same color as that of the inside panel 82 is attached to the surface of the rubber 85*b* of the cushion material 85.

Figure 25:
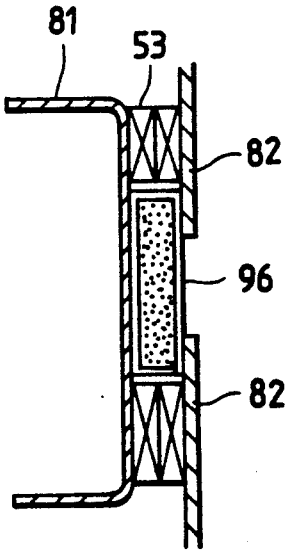
FIG. 25 shows still another embodiment corresponding to FIG. 22.

In still another embodiment of the invention shown in FIG. 25, a sponge rubber 96 with a CR type rubber surface protective film is used as the cushion material, and the decorative paper sheet 95 may be bonded onto the surface of the sponge rubber 96.

We claim:

1. A structure for fixing an inside panel of a car comprising:

a frame fixed to the car and having a plurality of first fasteners disposed on a surface of the frame;

a first inside panel having second fasteners disposed on the first inside panel, said second fasteners corresponding to said first fasteners and being disposed in positions facing said first fasteners;

a second inside panel; and a cushion material attached to said frame at a joint portion of said first and second inside, panels, and disposed along said joint portion;

said first and second fasteners together fixing said first inside panel to said inside frame, and said cushion material being positioned at said joint portion and on a back surface of an edge portion of each of said first and second inside panels at said joint portion.

2. A structure for fixing an inside panel of a car according to claim 1, wherein said first inside panel includes a decoration sheet bonded to a surface of the first inside panel and said decoration sheet being wrapped around at least an edge portion of said first inside panel.

3. A structure for fixing an inside panel of a car according to claim 2, wherein said cushion material has a decoration sheet having the same color as said decoration sheet bonded to the surface of the first inside panel.

4. A structure for fixing an inside panel of a car according to claim 1, wherein said cushion material comprises two layers, one layer facing a side of said frame and another layer facing a side of said inside panel, and the other layer being harder than the one layer.

5. A structure for fixing an inside panel of a car according to claim 4, wherein the one layer is a sponge material and the other layer is a rubber material.

6. A structure for fixing an inside panel of a car comprising:

a first inside panel having first fasteners disposed on a back surface of the first inside panel;

a second inside panel having second fasteners disposed on a back surface of the second inside panel, and disposed perpendicularly to said first inside panel;

a first frame having third fasteners corresponding to said first fasteners and disposed in positions facing said first fasteners;

a second frame having fourth fasteners corresponding to said second fasteners and disposed in positions facing said second fasteners; and a cushion material fitted to said second frame at a joint portion of said first and second inside panels, and having an edge portion in contact with said first inside panel.

7. A structure for fixing an inside panel of a car comprising:

an outside structure of the car;

an inside frame fixed to said outside structure, and having a plurality of first fasteners disposed on a surface of a center inside of a passenger room of the car;

said inside panel having a plurality of second fasteners disposed thereon, said second fasteners corresponding to said first fasteners and being disposed in positions facing said first fasteners; and said first fasteners and said second fasteners being adapted to be joined to fix said inside panel to said inside frame, wherein a portion of said inside frame being disposed in a position facing a lower end of said inside panel is folded toward an inside of the passenger room of the car, and wherein said lower end of said inside panel is placed on said folded portion of said inside frame for supporting said inside panel on said folded portion of said inside frame.

8. A structure for fixing an inside panel of a car comprising:

an outside structure of the car;

an inside frame fixed to said outside structure, and having a plurality of first fasteners disposed on a surface of a center inside of a passenger room of the car;

said inside panel having a plurality of second fasteners disposed thereon, said second fasteners corresponding to said first fasteners and being disposed in positions facing said first fasteners; and said first fasteners and said second fasteners being adapted to be joined to fix said inside panel to said inside frame, wherein a portion of an upper end of said inside panel is folded toward an outside of the passenger room of the car, and wherein said portion of said upper end of said inside panel is placed on a folded portion of said inside frame for supporting said inside panel on said folded portion of said inside frame.

9. A structure for fixing an inside panel of a car comprising:

an outside structure of the car;

an inside frame fixed to said outside structure, and having a plurality of first fasteners disposed on a surface of a center inside of a passenger room of the car;

said inside panel having ak plurality of second fasteners disposed thereon, said second fasteners corresponding to said first fasteners and being disposed in positions facing said first fasteners; and said first fasteners and said second fasteners being adapted to be joined to fix said inside panel to said inside frame, said inside frame including at least a pin disposed at a corner of the inside frame, said inside panel having at least a horizontal folded end portion provided with a pin hole, wherein said pin hole receives said pin for rotatably coupling the inside panel to said inside frame.

* * * * *